US010511128B2

(12) United States Patent
Kirk et al.

(10) Patent No.: US 10,511,128 B2
(45) **Date of Patent: *Dec. 17, 2019**

(54) CONNECTOR CONFIGURABLE FOR HIGH PERFORMANCE

(71) Applicant: Amphenol Corporation, Wallingford, CT (US)

(72) Inventors: Brian Kirk, Amherst, NH (US); Jason Si, Toronto (CA); Ba Pham, Toronto (CA); Sam Kocsis, Nashua, NH (US); David Chan, Xiamen (CN); Wonder Wang, Xiamen (CN); Bob Tang, Xiamen (CN); Martin Li, Xiamen (CN); Smith Wu, Xiamen (CN)

(73) Assignee: Amphenol Corporation, Wallingford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/362,541

(22) Filed: Mar. 22, 2019

(65) Prior Publication Data

US 2019/0221973 A1 Jul. 18, 2019

Related U.S. Application Data

(63) Continuation of application No. 15/683,199, filed on Aug. 22, 2017, now Pat. No. 10,243,304.
(Continued)

(51) Int. Cl.
*H01R 13/648* (2006.01)
*H01R 13/6585* (2011.01)
(Continued)

(52) U.S. Cl.
CPC ..... *H01R 13/6585* (2013.01); *H01R 13/6473* (2013.01); *H01R 13/6593* (2013.01);
(Continued)

(58) Field of Classification Search
CPC ..... H01R 13/6585; H01R 13/6473; H01R 13/6593; H01R 13/6594; H01R 13/6599; H01R 12/721; H01R 12/724
(Continued)

(56) References Cited

U.S. PATENT DOCUMENTS 2,996,710 A 8/1961 Pratt
3,002,162 A 9/1961 Garstang
(Continued)

FOREIGN PATENT DOCUMENTS

CN 1179448 C 12/2004
CN 1799290 A 7/2006
(Continued)

OTHER PUBLICATIONS

Extended European Search Report dated Jan. 24, 2012 for Application No. EP 11166820.8.
(Continued)

*Primary Examiner* — Khiem M Nguyen
(74) *Attorney, Agent, or Firm* — Wolf, Greenfield & Sacks, P.C.

(57) ABSTRACT

An electrical connector for high speed signals. The connector has multiple conductive elements that may serve as signal or ground conductors. A member formed with lossy material and conductive compliant members may be inserted in the connector. The conductive compliant members may be aligned with conductive elements of the connector configured as ground conductors. For a connector configured to carry differential signals, the ground conductors may separate pairs of signal conductors. The member may further include a conductive web, embedded within the lossy material, that interconnects the conductive compliant members. For a receptacle connector, the conductive elements may have mating contact portions aligned along opposing sur-
(Continued)

faces of a cavity. The conductive elements may have contact tails for attachment to a printed circuit board and intermediate portions connecting the mating contact portions and the contact tails. The conductive compliant members may press against the intermediate portions.

21 Claims, 7 Drawing Sheets

Related U.S. Application Data

(60) Provisional application No. 62/378,244, filed on Aug. 23, 2016.

(51) Int. Cl.
*H01R 13/6473* (2011.01)
*H01R 13/6593* (2011.01)
*H01R 13/6594* (2011.01)
*H01R 13/6599* (2011.01)
*H01R 12/72* (2011.01)

(52) U.S. Cl.
CPC ..... *H01R 13/6594* (2013.01); *H01R 13/6599* (2013.01); *H01R 12/721* (2013.01); *H01R 12/724* (2013.01)

(58) Field of Classification Search
USPC ..... 439/83, 607.09–607.11
See application file for complete search history.

(56) References Cited

U.S. PATENT DOCUMENTS 3,134,950 A 5/1964 Cook
3,322,885 A 5/1967 May et al.
3,786,372 A 1/1974 Epis et al.
3,825,874 A 7/1974 Peverill
3,863,181 A 1/1975 Glance et al.
4,155,613 A 5/1979 Brandeau
4,195,272 A 3/1980 Boutros
4,276,523 A 6/1981 Boutros et al.
4,371,742 A 2/1983 Manly
4,408,255 A 10/1983 Adkins
4,447,105 A 5/1984 Ruehl
4,471,015 A 9/1984 Ebneth et al.
4,484,159 A 11/1984 Whitley
4,490,283 A 12/1984 Kleiner
4,518,651 A 5/1985 Wolfe, Jr.
4,519,664 A 5/1985 Tillotson
4,519,665 A 5/1985 Althouse et al.
4,632,476 A 12/1986 Schell
4,636,752 A 1/1987 Saito
4,682,129 A 7/1987 Bakermans et al.
4,751,479 A 6/1988 Parr
4,761,147 A 8/1988 Gauthier
4,806,107 A 2/1989 Arnold et al.
4,846,724 A 7/1989 Sasaki et al.
4,846,727 A 7/1989 Glover et al.
4,878,155 A 10/1989 Conley
4,948,922 A 8/1990 Varadan et al.
4,970,354 A 11/1990 Iwasa et al.
4,975,084 A 12/1990 Fedder et al.
4,992,060 A 2/1991 Meyer
5,000,700 A 3/1991 Masubuchi et al.
5,066,236 A 11/1991 Broeksteeg
5,141,454 A 8/1992 Garrett et al.
5,150,086 A 9/1992 Ito
5,168,252 A 12/1992 Naito
5,168,432 A 12/1992 Murphy et al.
5,176,538 A 1/1993 Hansell, III et al.
5,266,055 A 11/1993 Naito et al.
5,280,257 A 1/1994 Cravens et al.
5,287,076 A 2/1994 Johnescu et al.
5,334,050 A 8/1994 Andrews
5,340,334 A 8/1994 Nguyen
5,346,410 A 9/1994 Moore, Jr.
5,429,520 A 7/1995 Morlion et al.
5,429,521 A 7/1995 Morlion et al.
5,433,617 A 7/1995 Morlion et al.
5,433,618 A 7/1995 Morlion et al.
5,456,619 A 10/1995 Belopolsky et al.
5,461,392 A 10/1995 Mott et al.
5,474,472 A 12/1995 Niwa et al.
5,484,310 A 1/1996 McNamara et al.
5,496,183 A 3/1996 Soes et al.
5,499,935 A 3/1996 Powell
5,551,893 A 9/1996 Johnson
5,562,497 A 10/1996 Yagi et al.
5,597,328 A 1/1997 Mouissie
5,651,702 A 7/1997 Hanning et al.
5,669,789 A 9/1997 Law
5,796,323 A 8/1998 Uchikoba et al.
5,831,491 A 11/1998 Buer et al.
5,924,899 A 7/1999 Paagman
5,981,869 A 11/1999 Kroger
5,982,253 A 11/1999 Perrin et al.
6,019,616 A 2/2000 Yagi et al.
6,152,747 A 11/2000 McNamara
6,168,469 B1 1/2001 Lu
6,174,203 B1 1/2001 Asao
6,174,944 B1 1/2001 Chiba et al.
6,217,372 B1 4/2001 Reed
6,293,827 B1 9/2001 Stokoe
6,296,496 B1 10/2001 Trammel
6,299,438 B1 10/2001 Shagian et al.
6,299,483 B1 10/2001 Cohen et al.
6,328,601 B1 12/2001 Yip et al.
6,347,962 B1 2/2002 Kline
6,350,134 B1 2/2002 Fogg et al.
6,364,711 B1 4/2002 Berg et al.
6,375,510 B2 4/2002 Asao
6,379,188 B1 4/2002 Cohen et al.
6,398,588 B1 6/2002 Bickford
6,409,543 B1 6/2002 Astbury, Jr. et al.
6,482,017 B1 11/2002 Van Doorn
6,503,103 B1 1/2003 Cohen et al.
6,506,076 B2 1/2003 Cohen et al.
6,517,360 B1 2/2003 Cohen
6,530,790 B1 3/2003 McNamara et al.
6,537,087 B2 3/2003 McNamara et al.
6,554,647 B1 4/2003 Cohen et al.
6,565,387 B2 5/2003 Cohen
6,579,116 B2 6/2003 Brennan et al.
6,582,244 B2 6/2003 Fogg et al.
6,595,802 B1 7/2003 Watanabe et al.
6,602,095 B2 8/2003 Astbury, Jr. et al.
6,616,864 B1 9/2003 Jiang et al.
6,652,318 B1 11/2003 Winings et al.
6,655,966 B2 12/2003 Rothermel et al.
6,709,294 B1 3/2004 Cohen et al.
6,713,672 B1 3/2004 Stickney
6,743,057 B2 6/2004 Davis et al.
6,776,659 B1 8/2004 Stokoe et al.
6,786,771 B2 9/2004 Gailus
6,814,619 B1 11/2004 Stokoe et al.
6,830,489 B2 12/2004 Aoyama
6,872,085 B1 3/2005 Cohen et al.
6,979,226 B2 12/2005 Otsu et al.
7,044,794 B2 5/2006 Consoli et al.
7,057,570 B2 6/2006 Irion, II et al.
7,074,086 B2 7/2006 Cohen et al.
7,094,102 B2 8/2006 Cohen et al.
7,108,556 B2 9/2006 Cohen et al.
7,163,421 B1 1/2007 Cohen et al.
7,285,018 B2 10/2007 Kenny et al.
7,335,063 B2 2/2008 Cohen et al.
7,494,383 B2 2/2009 Cohen et al.
7,540,781 B2 6/2009 Kenny et al.
7,581,990 B2 9/2009 Kirk et al.
7,588,464 B2 9/2009 Kim
7,722,401 B2 5/2010 Kirk et al.
7,731,537 B2 6/2010 Amleshi et al.

(56) References Cited

U.S. PATENT DOCUMENTS

| | | | |
|---|---|---|---|
| 7,753,731 | B2 | 7/2010 | Cohen et al. |
| 7,771,233 | B2 | 8/2010 | Gailus |
| 7,794,240 | B2 | 9/2010 | Cohen et al. |
| 7,794,278 | B2 | 9/2010 | Cohen et al. |
| 7,806,729 | B2 | 10/2010 | Nguyen et al. |
| 7,874,873 | B2 | 1/2011 | Do et al. |
| 7,887,371 | B2 | 2/2011 | Kenny et al. |
| 7,887,379 | B2 | 2/2011 | Kirk |
| 7,906,730 | B2 | 3/2011 | Atkinson et al. |
| 7,914,304 | B2 | 3/2011 | Cartier et al. |
| 7,985,097 | B2 | 7/2011 | Gulla |
| 8,083,553 | B2 | 12/2011 | Manter et al. |
| 8,182,289 | B2 | 5/2012 | Stokoe et al. |
| 8,215,968 | B2 | 7/2012 | Cartier et al. |
| 8,216,001 | B2 | 7/2012 | Kirk |
| 8,272,877 | B2 | 9/2012 | Stokoe et al. |
| 8,371,875 | B2 | 2/2013 | Gailus |
| 8,382,524 | B2 | 2/2013 | Khilchenko et al. |
| 8,657,627 | B2 | 2/2014 | McNamara et al. |
| 8,715,003 | B2 | 5/2014 | Buck et al. |
| 8,771,016 | B2 | 7/2014 | Atkinson et al. |
| 8,864,521 | B2 | 10/2014 | Atkinson et al. |
| 8,926,377 | B2 | 1/2015 | Kirk et al. |
| 8,944,831 | B2 | 2/2015 | Stoner et al. |
| 8,998,642 | B2 | 4/2015 | Manter et al. |
| 9,004,942 | B2 | 4/2015 | Paniauqa |
| 9,022,806 | B2 | 5/2015 | Cartier, Jr. et al. |
| 9,028,281 | B2 | 5/2015 | Kirk et al. |
| 9,124,009 | B2 | 9/2015 | Atkinson et al. |
| 9,219,335 | B2 | 12/2015 | Atkinson et al. |
| 9,225,085 | B2 | 12/2015 | Cartier, Jr. et al. |
| 9,300,074 | B2 | 3/2016 | Gailus |
| 9,450,344 | B2 | 9/2016 | Cartier, Jr. et al. |
| 9,484,674 | B2 | 11/2016 | Cartier, Jr. et al. |
| 9,509,101 | B2 | 11/2016 | Cartier, Jr. et al. |
| 9,520,689 | B2 | 12/2016 | Cartier, Jr. et al. |
| 10,243,304 | B2 * | 3/2019 | Kirk ..... H01R 13/6473 |
| 2001/0042632 | A1 | 11/2001 | Manov et al. |
| 2002/0042223 | A1 | 4/2002 | Belopolsky et al. |
| 2002/0089464 | A1 | 7/2002 | Joshi |
| 2002/0098738 | A1 | 7/2002 | Astbury et al. |
| 2002/0111068 | A1 | 8/2002 | Cohen et al. |
| 2002/0111069 | A1 | 8/2002 | Astbury et al. |
| 2004/0005815 | A1 | 1/2004 | Mizumura et al. |
| 2004/0020674 | A1 | 2/2004 | McFadden et al. |
| 2004/0115968 | A1 | 6/2004 | Cohen |
| 2004/0121652 | A1 | 6/2004 | Gailus |
| 2004/0196112 | A1 | 10/2004 | Welbon et al. |
| 2004/0259419 | A1 | 12/2004 | Payne et al. |
| 2005/0070160 | A1 | 3/2005 | Cohen et al. |
| 2005/0133245 | A1 | 6/2005 | Katsuyama et al. |
| 2005/0176835 | A1 | 8/2005 | Kobayashi et al. |
| 2005/0233610 | A1 | 10/2005 | Tutt et al. |
| 2005/0283974 | A1 | 12/2005 | Richard et al. |
| 2005/0287869 | A1 | 12/2005 | Kenny et al. |
| 2006/0068640 | A1 | 3/2006 | Gailus |
| 2006/0255876 | A1 | 11/2006 | Kushta et al. |
| 2007/0004282 | A1 | 1/2007 | Cohen et al. |
| 2007/0021001 | A1 | 1/2007 | Laurx et al. |
| 2007/0037419 | A1 | 2/2007 | Sparrowhawk |
| 2007/0042639 | A1 | 2/2007 | Manter et al. |
| 2007/0054554 | A1 | 3/2007 | Do et al. |
| 2007/0059961 | A1 | 3/2007 | Cartier et al. |
| 2007/0218765 | A1 | 9/2007 | Cohen et al. |
| 2008/0194146 | A1 | 8/2008 | Gailus |
| 2008/0246555 | A1 | 10/2008 | Kirk et al. |
| 2008/0248658 | A1 | 10/2008 | Cohen et al. |
| 2008/0248659 | A1 | 10/2008 | Cohen et al. |
| 2008/0248660 | A1 | 10/2008 | Kirk et al. |
| 2009/0011641 | A1 | 1/2009 | Cohen et al. |
| 2009/0011645 | A1 | 1/2009 | Laurx et al. |
| 2009/0035955 | A1 | 2/2009 | McNamara |
| 2009/0061661 | A1 | 3/2009 | Shuey et al. |
| 2009/0117386 | A1 | 5/2009 | Vacanti et al. |
| 2009/0239395 | A1 | 9/2009 | Cohen et al. |
| 2009/0258516 | A1 | 10/2009 | Hiew et al. |
| 2009/0291593 | A1 | 11/2009 | Atkinson et al. |
| 2009/0305533 | A1 | 12/2009 | Feldman et al. |
| 2010/0048058 | A1 | 2/2010 | Morgan et al. |
| 2010/0081302 | A1 | 4/2010 | Atkinson et al. |
| 2010/0294530 | A1 | 11/2010 | Atkinson et al. |
| 2011/0003509 | A1 | 1/2011 | Gailus |
| 2011/0104948 | A1 | 5/2011 | Girard, Jr. et al. |
| 2011/0212649 | A1 | 9/2011 | Stokoe et al. |
| 2011/0212650 | A1 | 9/2011 | Amleshi et al. |
| 2011/0230095 | A1 | 9/2011 | Atkinson et al. |
| 2011/0230096 | A1 | 9/2011 | Atkinson et al. |
| 2011/0256739 | A1 | 10/2011 | Toshiyuki et al. |
| 2011/0287663 | A1 | 11/2011 | Gailus et al. |
| 2012/0094536 | A1 | 4/2012 | Khilchenko et al. |
| 2012/0156929 | A1 | 6/2012 | Manter et al. |
| 2012/0184154 | A1 | 7/2012 | Frank et al. |
| 2012/0202363 | A1 | 8/2012 | McNamara et al. |
| 2012/0202386 | A1 | 8/2012 | McNamara et al. |
| 2012/0214344 | A1 | 8/2012 | Cohen et al. |
| 2013/0012038 | A1 | 1/2013 | Kirk et al. |
| 2013/0017733 | A1 | 1/2013 | Kirk et al. |
| 2013/0078870 | A1 | 3/2013 | Milbrand, Jr. |
| 2013/0109232 | A1 | 5/2013 | Paniaqua |
| 2013/0196553 | A1 | 8/2013 | Gailus |
| 2013/0217263 | A1 | 8/2013 | Pan |
| 2013/0225006 | A1 | 8/2013 | Khilchenko et al. |
| 2013/0316590 | A1 | 11/2013 | Hon |
| 2014/0004724 | A1 | 1/2014 | Cartier, Jr. et al. |
| 2014/0004726 | A1 | 1/2014 | Cartier, Jr. et al. |
| 2014/0004746 | A1 | 1/2014 | Cartier, Jr. et al. |
| 2014/0057498 | A1 | 2/2014 | Cohen |
| 2014/0273557 | A1 | 9/2014 | Cartier, Jr. et al. |
| 2014/0273627 | A1 | 9/2014 | Cartier, Jr. et al. |
| 2015/0056856 | A1 | 2/2015 | Atkinson et al. |
| 2015/0111427 | A1 | 4/2015 | Foxconn |
| 2015/0236451 | A1 | 8/2015 | Cartier, Jr. et al. |
| 2015/0236452 | A1 | 8/2015 | Cartier, Jr. et al. |
| 2015/0255926 | A1 | 9/2015 | Paniagua |
| 2016/0149343 | A1 | 5/2016 | Atkinson et al. |
| 2018/0062323 | A1 | 3/2018 | Kirk et al. |

FOREIGN PATENT DOCUMENTS

| | | | |
|---|---|---|---|
| CN | 101176389 | A | 5/2008 |
| CN | 101600293 | A | 12/2009 |
| CN | 101790818 | A | 7/2010 |
| CN | 101120490 | B | 11/2010 |
| CN | 201846527 | U | 5/2011 |
| CN | 102239605 | A | 11/2011 |
| CN | 101600293 | B | 5/2012 |
| CN | 102598430 | A | 7/2012 |
| DE | 60216728 | T2 | 11/2007 |
| EP | 1018784 | A1 | 7/2000 |
| EP | 1 779 472 | A1 | 5/2007 |
| EP | 2 169 770 | A2 | 3/2010 |
| EP | 2405537 | A1 | 1/2012 |
| GB | 1272347 | A | 4/1972 |
| JP | 07302649 | A | 11/1995 |
| JP | 2001-510627 | A | 7/2001 |
| JP | 2006-344524 | A | 12/2006 |
| MX | 9907324 | A1 | 8/2000 |
| WO | WO 88/05218 | A1 | 7/1988 |
| WO | WO 98/35409 | A1 | 8/1998 |
| WO | WO 2004/059794 | A2 | 7/2004 |
| WO | WO 2004/059801 | A1 | 7/2004 |
| WO | WO 2006/039277 | A1 | 4/2006 |
| WO | WO 2007/005597 | A2 | 1/2007 |
| WO | WO 2007/005599 | A1 | 1/2007 |
| WO | WO 2008/124057 | A1 | 10/2008 |
| WO | WO 2010/039188 | A1 | 4/2010 |

OTHER PUBLICATIONS

International Search Report with Written Opinion dated Oct. 31, 2007 for Application No. PCT/US2006/025562.

International Search Report and Written Opinion dated Jan. 26, 2006 for Application No. PCT/US2005/034605.

(56) References Cited

OTHER PUBLICATIONS

International Search Report and Written Opinion dated Mar. 14, 2011 for Application No. PCT/US2010/056482.
International Preliminary Report on Patentability dated May 24, 2012 for Application No. PCT/US2010/056482.
International Search Report and Written Opinion dated Nov. 22, 2011 for Application No. PCT/US2011/026139.
International Preliminary Report on Patentability dated Sep. 7, 2012 for Application No. PCT/US2011/026139.
International Search Report and Written Opinion dated Jul. 28, 2011 for Application No. PCT/US2011/034747.
International Search Report and Written Opinion dated Sep. 12, 2012 for Application No. PCT/US2012/023689.
International Preliminary Report on Patentability dated Aug. 15, 2013 for Application No. PCT/US2012/023689.
International Search Report and Written Opinion dated Mar. 29, 2013 for Application No. PCT/US2012/060610.
International Search Report and Written Opinion dated May 13, 2015 for Application No. PCT/US2015/012463.
International Search Report and Written Opinion for International Application No. PCT/US2017/047905 dated Dec. 4, 2017.
[No Author Listed], Carbon Nanotubes for Electromagnetic Interference Shielding. SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.
Beaman, High Performance Mainframe Computer Cables. 1997 Electronic Components and Technology Conference. 1997;911-7.
Shi et al, Improving Signal Integrity In Circuit Boards By Incorporating Absorbing Materials. 2001 Proceedings. 51st Electronic Components and Technology Conference, Orlando FL. 2001:1451-56.

* cited by examiner 710 750

| | | | |
|---|---|---|---|
| GRND | B1 | GRND | A1 |
| RX8 | B2 | TX1 | A2 |
| RX8 | B3 | TX1 | A3 |
| GRND | B4 | GRND | A4 |
| RX7 | B5 | TX2 | A5 |
| RX7 | B6 | TX2 | A6 |
| GRND | B7 | GRND | A7 |
| SIDEBAND | B8 | PROP CLK | A8 |
| SIDEBAND | B9 | PROP CLK | A9 |
| SIDEBAND | B10 | SIDEBAND | A10 |
| SIDEBAND | B11 | SIDEBAND | A11 |
| SIDEBAND | B12 | SIDEBAND | A12 |
| GRND | B13 | GRND | A13 |
| RX6 | B14 | TX3 | A14 |
| RX6 | B15 | TX3 | A15 |
| GRND | B16 | GRND | A16 |
| RX5 | B17 | TX4 | A17 |
| RX5 | B18 | TX4 | A18 |
| GRND | B19 | GRND | A19 |
| RX4 | B20 | TX5 | A20 |
| RX4 | B21 | TX5 | A21 |
| GRND | B22 | GRND | A22 |
| RX3 | B23 | TX6 | A23 |
| RX3 | B24 | TX6 | A24 |
| GRND | B25 | GRND | A25 |
| SIDEBAND | B26 | SIDEBAND | A26 |
| SIDEBAND | B27 | SIDEBAND | A27 |
| SIDEBAND | B28 | SIDEBAND | A28 |
| PROP CLK | B29 | SIDEBAND | A29 |
| PROP CLK | B30 | SIDEBAND | A30 |
| GRND | B31 | GRND | A31 |
| RX2 | B32 | TX7 | A32 |
| RX2 | B33 | TX7 | A33 |
| GRND | B34 | GRND | A34 |
| RX1 | B35 | TX8 | A35 |
| RX1 | B36 | TX8 | A36 |
| GRND | B37 | GRND | A37 |

720 720 720 720 720 720 720 720 720 720 720 720

FIG. 7

CONNECTOR CONFIGURABLE FOR HIGH PERFORMANCE

RELATED APPLICATIONS

This application is a continuation of U.S. patent application Ser. No. 15/683,199, filed Aug. 22, 2017, entitled "CONNECTOR CONFIGURABLE FOR HIGH PERFORMANCE," which claims priority to and the benefit of U.S. Provisional Patent Application No. 62/378,244, filed on Aug. 23, 2016, entitled "CONNECTOR CONFIGURABLE FOR HIGH PERFORMANCE." The entire contents of the foregoing application are hereby incorporated herein by reference.

BACKGROUND

This patent application relates generally to electrical connectors that may be configured to carry high frequency signals.

Electrical connectors are used in many electronic systems. It is generally easier and more cost effective to manufacture a system as separate electronic assemblies, such as printed circuit boards ("PCBs"), which may be joined together with electrical connectors. A known arrangement for joining several printed circuit boards within a single enclosure is to have one printed circuit board serve as a backplane. Other printed circuit boards, called "daughterboards" or "daughtercards," may be connected through the backplane. Connectors designed for this connecting daughtercards and backplanes are widely used.

Some electronic systems are assembled with electronic components in different enclosures. Those enclosures may be connected with cables, which may be optical fiber cables but more commonly contain electrically conducting wires for conveying electrical signals. To facilitate easy assembly of the system, the cables may be terminated with cable connectors, sometimes called plugs. The plug is designed to mate with a corresponding connector, sometimes called a receptacle connector, attached to a printed circuit board inside an enclosure of an electronic device. A receptacle connector may have one or more ports that are designed to be exposed in a panel of the enclosure. Typically, a plug can be inserted into each port.

To facilitate manufacture of different portions of electronic system in different places by different companies, aspects of the receptacle connectors and the plug connectors may be standardized, either through a formal standard setting process or through adoption of a particular design by a large number of manufacturers. An example of a standard is referred to as SAS. As another example, several such standards exist as a result and are referred generally to "small form factor pluggable" (SFP) connectors. Variations of these standards exist under names such as SFP, QSFP, QSFP+, etc.

Different standards have been developed as electronic systems generally have gotten smaller, faster, and functionally more complex. The different standards allow for different combinations of speed and density within a connector system.

For standards that require a high density, high speed connector, techniques may be used reduce interference between conductive elements within the connectors, and to otherwise provide desirable electrical properties. One such technique involves the use of shield members between or around adjacent signal conductors. The shields may prevent signals carried on one conductive element from creating "crosstalk" on another conductive element. The shield may also impact the impedance of each conductive element, which may further contribute to desirable electrical properties of the connector system.

Another technique that may be used to control the performance of a connector entails transmitting signals differentially. Differential signals are carried on a pair of conducting paths, called a "differential pair." The voltage difference between the conductive paths represents the signal. In general, a differential pair is designed with preferential coupling between the conducting paths of the pair. For example, the two conducting paths of a differential pair may be arranged to run closer to each other than to adjacent signal paths in the connector.

Amphenol Corporation also pioneered the use of "lossy" material in connectors to improve performance, particularly of high speed, high density connectors.

SUMMARY

According to one aspect of the present application, an electrical connector comprises a first subassembly comprising a first plurality of conductive elements disposed in a first row, each conductive element of the first plurality having a mating contact portion, a contact tail and an intermediate portion connecting the mating contact portion and the contact tail. The electrical connector also comprises a second subassembly comprising a second plurality of conductive elements disposed in a second row, each conductive element of the second plurality having a mating contact portion, a contact tail and an intermediate portion connecting the mating contact portion and the contact tail. A member may be disposed between the first subassembly and the second subassembly, the member comprising lossy material and a plurality of conductive, compliant members extending from the lossy material. The conductive compliant members of the plurality of conductive compliant members make contact with a portion of conductive elements of the first plurality of conductive elements and a portion of the conductive elements of the second plurality of conductive elements.

In a further aspect, an electrical connector may comprise a plurality of conductive elements disposed in at least one row, each conductive element of the plurality having a mating contact portion, a contact tail and an intermediate portion connecting the mating contact portion and the contact tail. The connector may also comprise a member comprising an electrically lossy body elongated in a direction parallel to the row; and a plurality of conductive, compliant members extending from the lossy body. The conductive compliant members may make contact with a portion of the plurality of conductive elements.

In yet another aspect, an electrical connector configured as a receptacle for a plug of a cable assembly may comprise an insulative housing comprising at least one cavity configured to receive the plug, the cavity comprising a first surface and a second surface, opposing the first surface; a first plurality of conductive elements, each having a portion disposed along the first surface; a second plurality of conductive elements, each having a portion disposed along the second surface; and a member disposed within the housing, the member comprising lossy material and a plurality of conductive members extending from the lossy material. Conductive members of the plurality of conductive members may make contact with a portion of the conductive elements of the first plurality of conductive elements and a portion of the conductive elements of the second plurality of conductive elements.

The foregoing is a non-limiting summary of the invention, which is defined only by the appended claims.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings:

FIG. 7 is a schematic illustration of assignments of conductive elements within a connector to functions.

DETAILED DESCRIPTION

Figure 1:
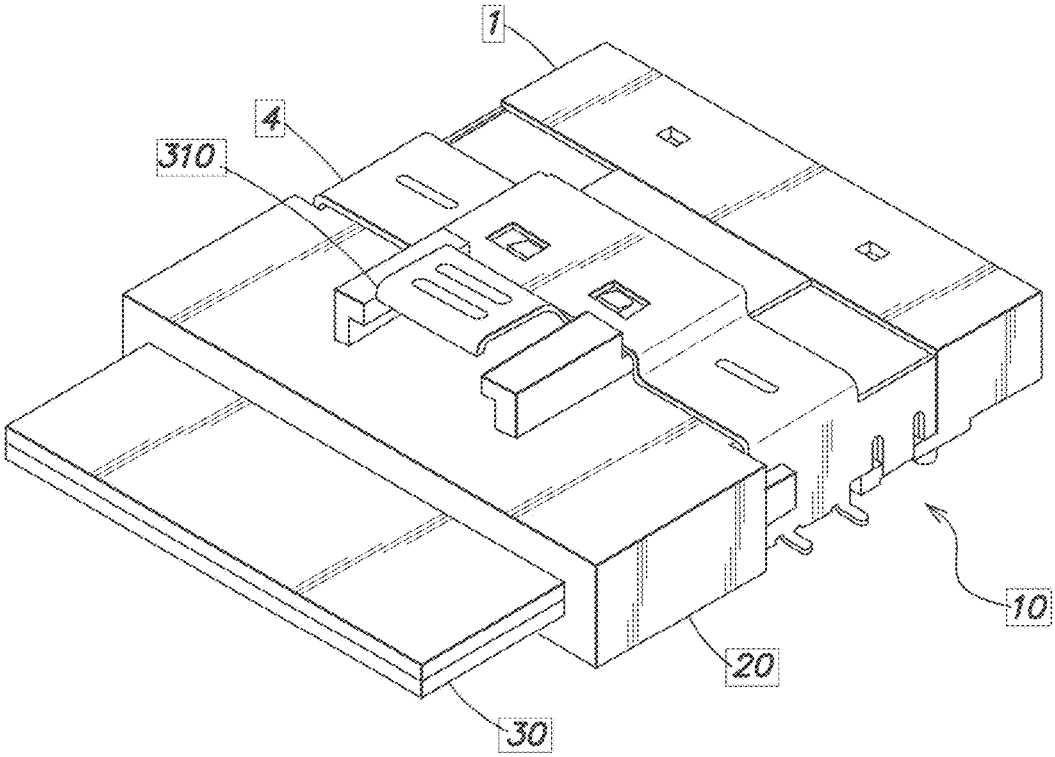
FIG. 1 is a perspective view of a receptacle connector according to some embodiments, shown mated to a complementary plug connector (in phantom)

The inventors have recognized and appreciated that that the utility of an electrical connector may be substantially improved by configuring the connector to receive a member that includes both lossy material and conductive members. The conductive members may extend from one or more surfaces of the lossy material. Some or all of the conductive members may be electrically connected, such as through a conductive web embedded in the lossy material or through the lossy material itself. Accordingly the member may act as a shorting member, shorting together structures contacting the conductive members.

The conductive members may make electrical connections with the conductive elements within the connector. The conductive members may be aligned with conductive elements positioned to act as ground conductors. When the shorting member is installed in the connector, the combined action of the conductive members and the lossy material may reduce resonances involving the conductive elements within the connector.

When the connector operates at a higher frequency (e.g., 25 GHz, 30 GHz, 35 GHz, 40 GHz, 45 GHz, etc.), the shorting member may be installed. When installed, the shorting member may reduce resonances at frequencies that are at a high frequency portion of a desired operating range of the connector, thereby enabling operation in the high frequency portion and increasing the operating range of the connector. For applications that do not require operation at frequencies in the high frequency potion of the operating range, the shorting member may be omitted, providing a lower cost connector configuration.

To support selective inclusion of the shorting member in the connector the housing may have a cavity or other features shaped to receive the shorting member. The conductive members of the shorting member may be compliant such that they can be compressed when inserted in the connector. Compression of the conductive, complaint members may generate a spring force to make a reliable electrical connection between the conductive compliant members and the conductive elements within the connector.

Isolative portions of the connector housing may be shaped to receive the shorting member and to expose portions of conductive elements so that contact may be made between the conductive elements and the conductive members of the shorting member. In some embodiments, the conductive elements of the connector may have mating contact portions, configured for mating with a complementary connector, and contact tails, configured for attachment to a printed circuit board. The conductive elements may further have intermediate portions joining the contact tails and the mating contact portions. The housing may be configured to expose a portion of the intermediate portions of at least those conductive elements designed as ground contacts for contact with the conductive members of the shorting member.

In accordance with some embodiments, the conductive elements of the connector may be organized in rows. The conductive members extending from the shorting member may be positioned to contact selective ones of the conductive elements in at least one row. In some embodiments, conductive members may extend from two opposing surfaces of the lossy portion of the shorting member. Such a configuration may enable the conductive members to contact conductive elements in two adjacent rows. In such a configuration, the shorting member may be elongated in a direction parallel to the row and may be configured as a shorting bar.

In accordance with some embodiments, the connector may be a receptacle connector. A receptacle, for example, may have a port shaped to receive a paddle card of a mating electrical connector. Mating contact portions of the conductive elements of the receptacle may line two opposing surfaces of the port, forming two adjacent rows of conductive elements. In some embodiments, the conductive elements in each row may be formed as a separate subassembly, such as by molding an insulative portion around a lead frame comprising the row of conductive elements. The shorting member may be lodged between the subassemblies, with the conductive members of the shorting member making electrical connection with selective ones of the conductive element in each row.

Turning to FIG. 1, an exemplary embodiment of a connector that may be selectively configured with a shorting member as described herein is illustrated. In this example, the connector is a receptacle connector 10, of the type known in the art to be attached to a printed circuit board. A printed circuit board may include ground planes and signal traces connected to pads on the surface of the printed circuit board. Receptacle connector 10 may include conductive elements with contact tails that may be attached to pads on the printed circuit board. Any suitable attachment technique may be used, including those known in the art. For example, in the embodiment illustrated, the contact tails are configured for attachment to a printed circuit board using a surface mount solder technique.

In the example shown, the receptacle connector 10 includes a housing 1. Housing 1 may be formed of insulative material, which may be a dielectric material. In various embodiments, housing 1 may be molded or over-molded from a dielectric material such as plastic or nylon. Examples of suitable materials include, but are not limited to, liquid crystal polymer (LCP), polyphenyline sulfide (PPS), high temperature nylon or polyphenylenoxide (PPO) or polypropylene (PP). Other suitable materials may be employed, as aspects of the present disclosure are not limited in this regard.

All of the above-described materials are suitable for use as binder material in manufacturing connectors. In accordance some embodiments, one or more fillers may be included in some or all of the binder material. To form an insulative housing, the fillers may also be insulative. As a non-limiting example, thermoplastic PPS filled to 30% by volume with glass fiber may be used to form the entire connector housing or dielectric portions of the housing.

In the embodiment illustrated, housing 1 is integrally formed as a single component. In other embodiments, housing 1 may be formed as multiple components that are separately formed and then connected together.

Conductive elements inside receptacle connector 10 may be supported, directly or indirectly, by housing 1. Conductive elements may be made of metal or any other material that is conductive and provides suitable mechanical properties for conductive elements in an electrical connector. Phosphor-bronze, beryllium copper and other copper alloys are non-limiting examples of materials that may be used. The conductive elements may be formed from such materials in any suitable way, including by stamping and/or forming.

Each conductive element may have a contact tail adapted for mounting to a printed circuit board or other substrate to which receptacle connector 10 may be attached. A printed circuit board may have multiple ground planes and multiple signal traces within the printed circuit board. Conductive vias, extending perpendicularly to the surface of the printed circuit board, may enable connections between the ground planes and signal traces within the printed circuit board and the contact tails of receptacle connector 10.

Each conductive element within receptacle connector 10 may also have a mating contact at an end of the conductive element opposing the contact tail. The mating contact may be configured for contacting a corresponding conductive element in a mating connector. The mating contact and contact tail of each conductive element may be electrically connected by an intermediate portion of the conductive elements. The intermediate portion may carry signals between the contact tail and the mating contact. The intermediate portion may also be attached, directly or indirectly, to housing 1.

To make electrical connections between the printed circuit board to which receptacle connector 10 is mounted and another electronic component, a mating connector may be inserted into receptacle connector 10. The mating connector may also be attached to a substrate that supports conductive members that carry signals and ground potentials. In the embodiment illustrated, the substrate is a cable 30. Accordingly, the mating connector is plug 20. Plug 20 may be inserted into receptacle connector 10.

In this example, plug 20 terminates cable 30. Cable 30 includes multiple conductors, which may be terminated at a second end (not visible in FIG. 1) to another plug connector for insertion into another electronic assembly with a receptacle connector or otherwise connected to an electronic assembly.

Plug connector 20 may include conductive elements positioned to make mechanical and electrical contact with the conductive elements inside receptacle connector 10. As with the conductive elements in receptacle 10, the conductive elements in the plug 20 may have a mating contact and a contact tail joined by an intermediate portion. However, the conductive elements of plug 20 may be shaped differently than the conductive elements of receptacle 10. As one difference, the contact tails of the conductive elements in plug 20 may be shaped to be attached to conductors in cable 30 rather than shaped for connection to a printed circuit board. The conductive elements of plug 20 are shown in greater detail in FIG. 3, discussed below.

One or both of receptacle connector 10 and plug connector 20 may include features to hold the connectors together when mated. In the example of FIG. 1, receptacle connector 10 includes a latching clip 4 overlaying housing 1. In this example, latching clip 4 is formed of a conductive material, such as metal. Alternatively, latching clip 4 may be formed of a dielectric material, such as plastic, or other suitable material.

Plug connector 20 includes a member designed to engage with latching clip 4. In FIG. 1, latch release tab 310 is visible. Latch release tab 310 may be connected to projections 312 (FIG. 3) that engage openings 206 (FIG. 2) of latching clip four. Latching tab 310 may be formed of the springy material, such as metal. When latch tab 310 is depressed, projections 312 (FIG. 3) may move out of engagement with openings 206, allowing the plug 20 to be pulled out of receptacle 10. Conversely, when latch tab 310 is released, the spring motion of latch tab 310 may urge projections 312 into engagement with openings 206, preventing plug 20 from being pulled out of receptacle 10.

Figure 2:
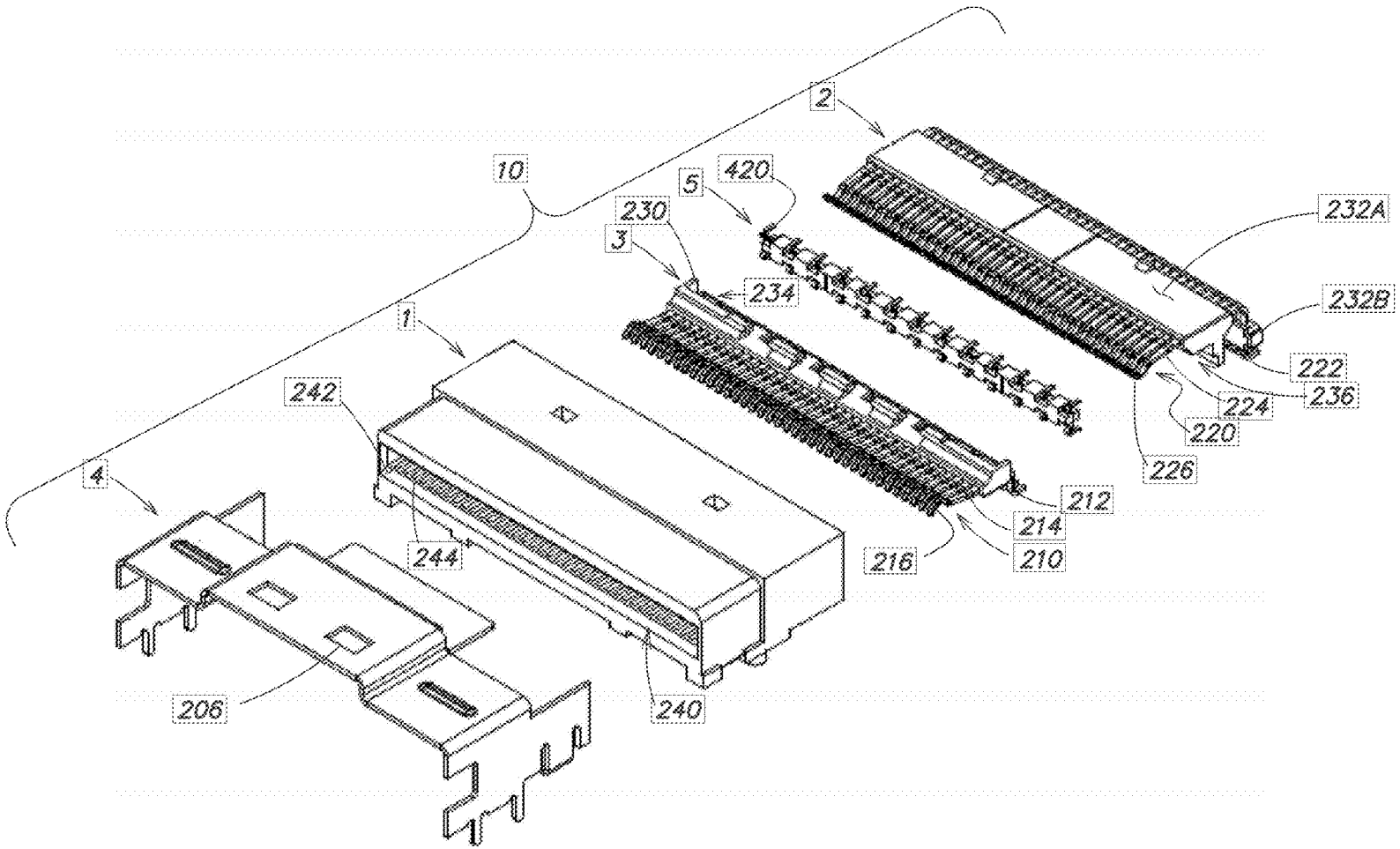
FIG. 2 is an exploded view of the receptacle connector of FIG. 1.

FIG. 2 shows an exploded view of receptacle connector 10. In the example of FIG. 2, housing 1 includes a cavity 240, forming a portion of the mating interface of receptacle connector 10. Cavity 240 may form one port of the receptacle connector. Cavity 240 has a lower surface of 242 and an upper surface (not visible in FIG. 2). Each of these surfaces includes a plurality of parallel channels, of which channel 244 is numbered. Each of the channels is configured to receive a mating contact of a conductive element.

In the embodiment of FIG. 2, the conductive elements are held together in wafers, which are inserted into housing 1. FIG. 2 shows upper contact wafer 2 and lower contact wafer 3. Each of upper contact wafer 2 and lower contact wafer 3 provides a row of conductive elements. Lower contact wafer 3 provides a row of conductive elements 210 that have mating contact portions 216 that fit with in channels 244 of lower surface 242.

Figure 3:
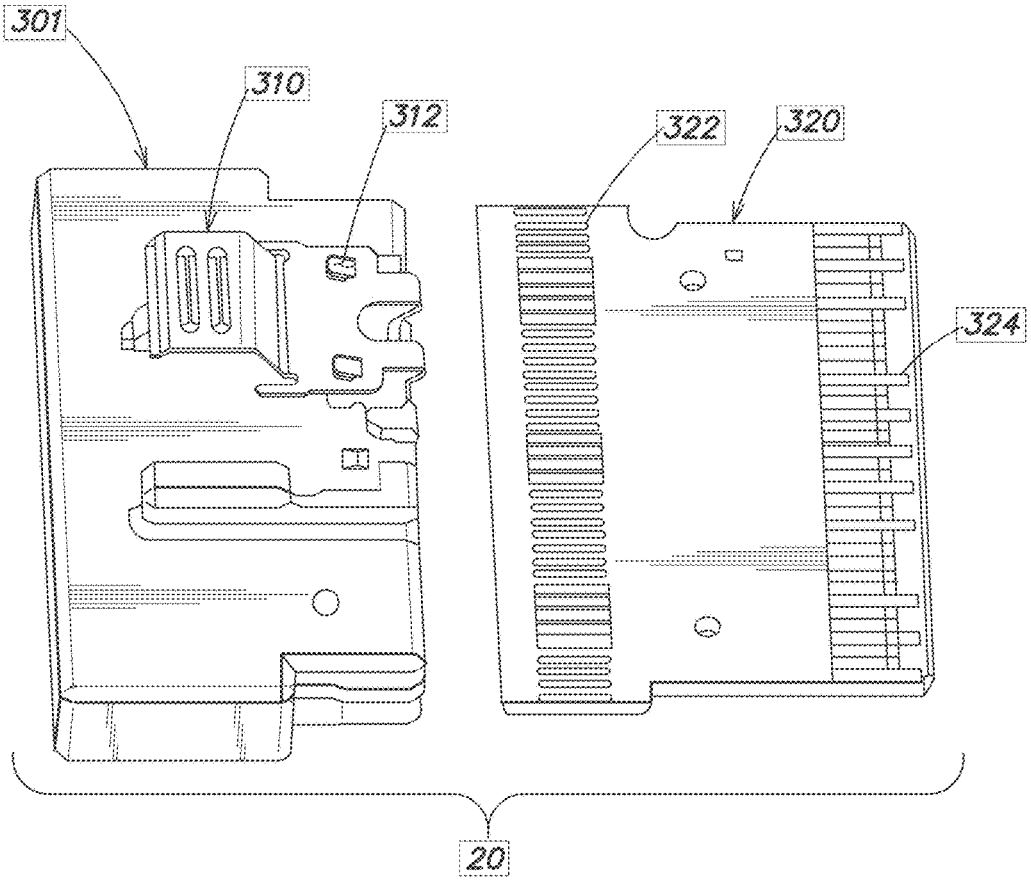
FIG. 3 is an exploded view of the plug connector of FIG. 1, without a cable attached.

In the embodiment illustrated in FIG. 2, mating contact portions 216 are shaped as compliant beams. Each of the mating contact portions 216 is curved, providing a mating contact surface on the concave side of that curve. Such a shape is suitable for mating with mating contacts that are shaped as pads. Accordingly, in the example of FIG. 2, a mating plug may contain conductive elements having mating contact portions shaped as pads, as illustrated in FIG. 3. However, it should be appreciated that the mating contact portions of receptacle 10 and plug 20 may be of any suitable size and shape that are complementary.

When lower contact wafer 3 is inserted in to housing 1, mating contact portions 216 are exposed in the lower surface 242, providing a mechanism for the conductive elements to make contact with corresponding conductive elements in plug 20 when plug 20 is inserted into cavity 240. Intermediate portions 214 extend through housing 1, allowing contact tails 212 to be exposed at a lower surface (not visible in FIG. 2) of housing 1 such that contact tails 212 may be attached to a printed circuit board.

In the embodiment illustrated, lower contact wafer 3 is formed as a subassembly, such as by molding an insulative portion 230 around the intermediate portions 214 of a row of conductive elements.

Upper contact wafer 2 has a row of conductive elements 220, and maybe formed similarly to lower contact wafer 3, with insulative portions formed around a row of conductive elements 220. The conductive elements 220 may be positioned to fit within channels in the upper surface (not visible in FIG. 2) of cavity 240. When positioned in the channels, the mating contact portions 226 of conductive elements 220 may be exposed in the upper surface of cavity 240, allowing contact with conductive elements in plug 20. The conductive elements 220 of upper contact wafer 2 similarly have intermediate portions 224 connected to contact tails 222 for attaching the conductive elements to a printed circuit board. In the example of FIG. 2, the housing of upper contact wafer 2, holding a row of conductive elements, is formed in two pieces, housing portion 232A and housing portion 232B. Each may be formed by insert molding a suitable dielectric material around the conductive elements 220 forming upper contact wafer 2.

FIG. 2 also shows shorting bar 5 that may optionally be included within receptacle connector 10. Shorting bar 5 may be included to expand the frequency range over which the interconnection system illustrated in FIG. 1 may operate. In some embodiments, conducting structures of receptacle connector 10 may support resonant modes at a fundamental frequency within a frequency range of interest for operation of the connector. In that scenario, including shorting bar 5, may alter the fundamental frequency of the resonant mode such that it occurs outside the frequency range of interest. Without the fundamental frequency of the resonant mode in the frequency range of interest, one or more performance characteristics of the connector may be at an acceptable level over the frequency range of interest while, without shorting bar 5, the performance characteristic would be unacceptable. Conversely, when performance characteristics are suitable over the frequency range of interest without shorting bar 5, shorting bar 5 may be omitted to provide a lower cost connector.

The frequency range of interest may depend on the operating parameters of the system in which such a connector is used, but may generally have an upper limit between about 15 GHz and 50 GHz, such as 25, 30 or 40 GHz, although higher frequencies or lower frequencies may be of interest in some applications. Some connector designs may have frequency ranges of interest that span only a portion of this range, such as 1 to 10 GHz or 3 to 15 GHz or 5 to 35 GHz.

The operating frequency range for an interconnection system may be defined based on the range of frequencies that pass through the interconnection with acceptable signal integrity. Signal integrity may be measured in terms of a number of criteria that depend on the application for which an interconnection system is designed. Some of these criteria may relate to the propagation of the signal along a single-ended signal path, a differential signal path, a hollow waveguide, or any other type of signal path. The criteria may be specified as a limit or range of values for performance characteristics. Two examples of such characteristics are the attenuation of a signal along a signal path or the reflection of a signal from a signal path.

Other characteristics may relate to interaction of signals on multiple distinct signal paths. Such characteristics may include, for example, near end cross talk, defined as the portion of a signal injected on one signal path at one end of the interconnection system that is measurable at any other signal path on the same end of the interconnection system. Another such characteristic may be far end cross talk, defined as the portion of a signal injected on one signal path at one end of the interconnection system that is measurable at any other signal path on the other end of the interconnection system.

As specific examples of criteria, it could be required that signal path attenuation be no more than 3 dB power loss, reflected power ratio be no greater than −20 dB, and individual signal path to signal path crosstalk contributions be no greater than −50 dB. Because these characteristics are frequency dependent, the operating range of an interconnection system is defined as the range of frequencies over which the specified criteria are met.

Designs of an electrical connector are described herein that improve signal integrity for high frequency signals, such as at frequencies in the GHz range, including up to about 25 GHz or up to about 40 GHz or higher, while maintaining high density, such as with a spacing between adjacent mating contacts on the order of 3 mm or less, including center-to-center spacing between adjacent contacts in a column of between 0.5 mm and 2.5 mm or between 0.5 mm and 1 mm, for example. As a specific example, center-to-center spacing may be 0.6 mm. The conductive elements may have a width of about 0.3-0.4 mm, leaving an edge to edge spacing between conductive elements on the order of 0.1 mm.

Shorting bar 5 may be incorporated into receptacle connector 10 by inserting shorting bar 5 into housing 1 when contact wafers 2 and 3 are inserted. As a specific example, shorting bar 5 may be positioned between upper contact wafer 2 and lower contact wafer 3 before the contact wafers are inserted into a housing 1.

Each of the contact wafers may include one or more features that secures the contact wafer in housing 1. For example, the contact wafer 3 may include a latching or other snap fit feature. Alternatively or additionally, housing 1 may include features that secure contact wafer in the housing when inserted.

Figure 4:
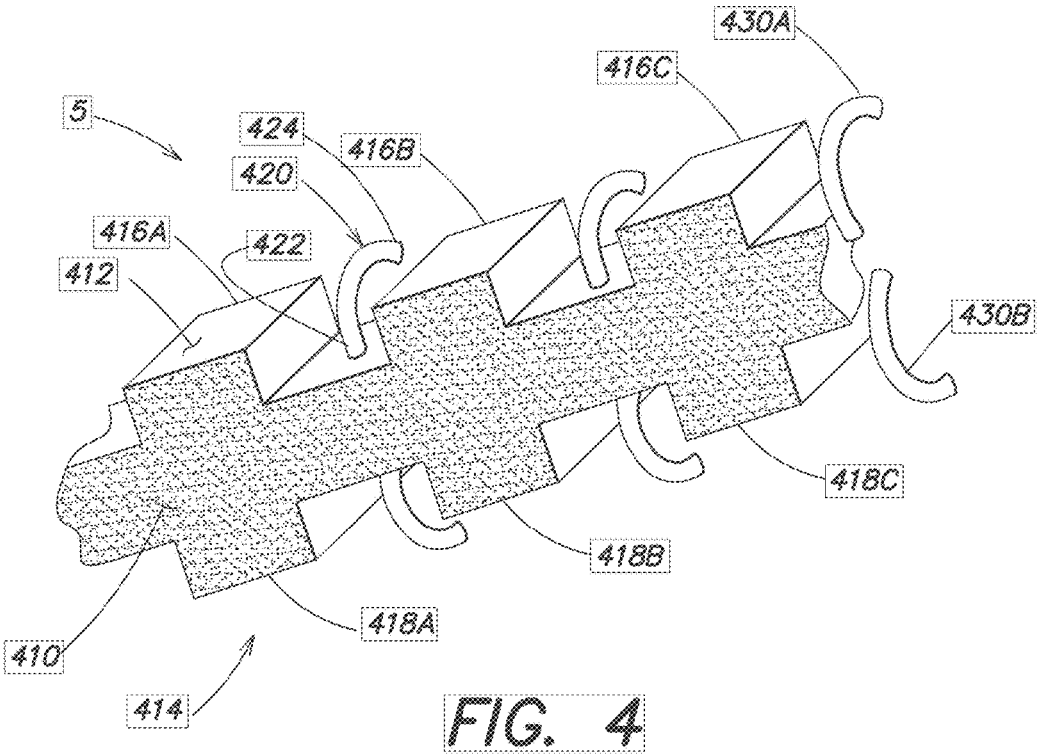
FIG. 4 is a perspective view, particularly cut away, of a first illustrative embodiment of a shorting member that may be installed in the receptacle connector of FIG. 1.

In the embodiment illustrated in FIG. 2, if used, shorting bar 5 may be held between lower contact wafer 3 and upper contact wafer 2. In the example illustrated, the rearward surface of insulative portion 230 may include openings 234. Openings 234 may be shaped to receive the shorting bar 5. As shown in FIG. 4, shorting bar 5 has a body 410 and compliant conductive members 420 extending from the body 410. The opening 234 may be shaped such that body 410 presses against the insulative portion 230. Opening 234 may further be shaped to expose intermediate portions 214 of selective ones of the conductive elements 210 in lower contact wafer 3. Compliant conductive members 420 may make contact to selective ones of the conductive elements 210. As a result of the shape of shorting bar 5 and insulative portion 230, the compliant conductive members 420 may be insulated from others of the conductive elements 210. Likewise, the body 410 may be insulated from those non-selected conductive elements 210.

Insulative portion 232A of upper contact wafer 2 may press against shorting bar 5, pressing it into insulative portion 230. With both lower contact wafer 3 and upper contact wafer 2 secured in housing 1, shorting bar 5 will also be secured within receptacle connector 10.

The surfaces of insulative portion 232A pressing against shorting bar 5 may similarly have openings 236 into which shorting bar 5 may fit. Those openings may also be shaped to expose selective ones of the mating contacts 220. The compliant conductive members 420 (FIG. 4) of the shorting bar 5 may contact the intermediate portions of selective ones of the conductive elements 220 of upper contact wafer 2. As a result of the shape of shorting bar 5 and insulative portion 232A, both the compliant conductive members 420 and body 410 of shorting bar 5 may be insulated from the non-selected conductive elements.

As described below, the selected conductive elements that are contacted by the compliant conductive members of the shorting bar 5 may be designated as ground conductors. In operation of an interconnection system, the ground conductors are intended to be connected to a conductive member of a printed circuit board or other substrate that carries a ground potential or other voltage level that serves as a reference potential for the electronic system containing the connector. Such connections have been found to increase the fundamental frequency of resonances excited within the connector, improving the frequency range over which the connector operates.

Turning to FIG. 3, further detail of a plug 20 is shown. In this example, plug 20 includes insulative housing 301. Housing 301 may be formed of the same types of materials used to form housing 1 or any other suitable material.

In this example, the conductive elements within plug connector 20 are implemented as conductive traces on printed circuit board 320, which serves as a paddle card for plug 20. Printed circuit board 320 may be a two-sided printed circuit board. Conductive traces formed on an upper surface of printed circuit board 320 may be aligned with mating contact portions 220 (FIG. 2) lining the upper surface of cavity 240 of a receptacle connector 10. Conductive traces on the lower surface of printed circuit board 320 may align with mating contact portions 216 of conductive elements lining the lower surface 244 of cavity 240.

In FIG. 3, the upper surface of printed circuit board 320 is visible with a row of contact pads 324. The contact pads 324 may be connected to traces within printed circuit board 320 and may serve as mating contacts for a first portion of the conductive elements within plug 20. A similar row of contact pads on a lower surface a printed circuit board 320 may serve as mating contacts for a second portion of the conductive elements within the plug 20. FIG. 3 shows an exploded view of plug 20. When assembled, the row of pads 324 may extend from plug housing 301, such that when printed circuit board 320 is inserted into cavity 240 (FIG. 2) the mating contact portions of the conductive elements within receptacle connector 10 press against the pads 324 on printed circuit board 320, forming conductive paths through the interconnection system formed by mating plug 20 to receptacle 10.

Printed circuit board 320 has a second row of pads 322. When plug 20 is assembled, pads 322 will be inside housing 301. The pads 322 are designed such that conductors from cable 30 (FIG. 1) may be attached to the pads. Cable conductors may be attached to pads 322 in any suitable way, such as soldering or brazing. Securing housing 301 to printed circuit board 320 may press cable 30 against printed circuit board 320, aiding in securing cable 30 to printed circuit board 320. In the example shown in FIG. 1, cable 30 has an upper and a lower portion, providing conductors to be secured to pads on the upper and lower surfaces of printed circuit board 320.

FIG. 3 also reveals additional details of latch release 310, including projections 312.

Turning to FIG. 4, additional details of shorting bar 5 are shown. Shorting bar 5 has a body 410. As can be seen in FIG. 4 viewed in conjunction with FIG. 2, body 410 is elongated parallel to the rows of conductive elements in receptacle 10.

Body 410 may have any suitable shape. In the example of FIG. 4, body 410 includes castellations 416A, 416B, 416C . . . on upper surface 412 and castellations 418A, 418B, 418C . . . on lower surface 414. Compliant conductive members 420 extend from body 410 in locations between the castellations.

In the example of FIG. 4, compliant conductive members 420 extend from an upper surface 412 and an opposing lower surface 414. As described above in connection with FIG. 2, the compliant conductive members 420 are positioned along upper surface 412 and lower surface 414 to make contact with selective ones of the conductive elements 220 of upper contact wafer 2 and conductive elements 210 of lower contact wafer 3, respectively. Compliant conductive members may be formed of any material that is suitably compliance and conductive, such as the medals mentioned above for use in forming conductive elements of receptacle 10.

The portions of compliant conductive members 420 extending from body 410 may be shaped to press against the intermediate portions of the conductive elements in upper contact wafer 2 and lower contact wafer 3 when the shorting bar 5 is installed between lower contact wafer 3 and upper contact wafer 2. In this example, compliance of a conductive member 420 may be achieved by a bend in an elongated member extending from body 410. For example, a portion 422 may extend in a direction perpendicular to a surface of body 410. That member may have a bend creating a transverse portion 424 at a distal end of conductive member 420. The bend and/or transverse portion 424 may serve as a contact for making electrical connection to a conductive element in connector 10.

Body 410 may be formed of a lossy material. Any suitable lossy material may be used. Materials that conduct, but with some loss, or material which by another physical mechanism absorbs electromagnetic energy over the frequency range of interest are referred to herein generally as "lossy" materials. Electrically lossy materials can be formed from lossy dielectric and/or poorly conductive and/or lossy magnetic materials. Magnetically lossy material can be formed, for example, from materials traditionally regarded as ferromagnetic materials, such as those that have a magnetic loss tangent greater than approximately 0.05 in the frequency range of interest. The "magnetic loss tangent" is the ratio of the imaginary part to the real part of the complex electrical permeability of the material. Practical lossy magnetic materials or mixtures containing lossy magnetic materials may also exhibit useful amounts of dielectric loss or conductive loss effects over portions of the frequency range of interest. Electrically lossy material can be formed from material traditionally regarded as dielectric materials, such as those that have an electric loss tangent greater than approximately 0.05 in the frequency range of interest. The "electric loss tangent" is the ratio of the imaginary part to the real part of the complex electrical permittivity of the material. Electrically lossy materials can also be formed from materials that are generally thought of as conductors, but are either relatively poor conductors over the frequency range of interest, contain conductive particles or regions that are sufficiently dispersed that they do not provide high conductivity or otherwise are prepared with properties that lead to a relatively weak bulk conductivity compared to a good conductor such as copper over the frequency range of interest.

Electrically lossy materials typically have a bulk conductivity of about 1 siemen/meter to about 100,000 siemens/meter and preferably about lsiemen/meter to about 10,000 siemens/meter. In some embodiments material with a bulk conductivity of between about 10 siemens/meter and about 200 siemens/meter may be used. As a specific example, material with a conductivity of about 50 siemens/meter may be used. However, it should be appreciated that the conductivity of the material may be selected empirically or through electrical simulation using known simulation tools to determine a suitable conductivity that provides both a suitably low crosstalk with a suitably low signal path attenuation or insertion loss.

Electrically lossy materials may be partially conductive materials, such as those that have a surface resistivity between 1 Ω/square and 100,000 Ω/square. In some embodiments, the electrically lossy material has a surface resistivity between 10 Ω/square and 1000 Ω/square. As a specific example, the material may have a surface resistivity of between about 20 Ω/square and 80 Ω/square.

In some embodiments, electrically lossy material is formed by adding to a binder a filler that contains conductive particles. In such an embodiment, a lossy member may be formed by molding or otherwise shaping the binder with filler into a desired form. Examples of conductive particles that may be used as a filler to form an electrically lossy material include carbon or graphite formed as fibers, flakes, nanoparticles, or other types of particles. Metal in the form of powder, flakes, fibers or other particles may also be used to provide suitable electrically lossy properties. Alternatively, combinations of fillers may be used. For example, metal plated carbon particles may be used. Silver and nickel are suitable metal plating for fibers. Coated particles may be used alone or in combination with other fillers, such as carbon flake. The binder or matrix may be any material that will set, cure, or can otherwise be used to position the filler material. In some embodiments, the binder may be a thermoplastic material traditionally used in the manufacture of electrical connectors to facilitate the molding of the electrically lossy material into the desired shapes and locations as part of the manufacture of the electrical connector. Examples of such materials include liquid crystal polymer (LCP) and nylon. However, many alternative forms of binder materials may be used. Curable materials, such as epoxies, may serve as a binder. Alternatively, materials such as thermosetting resins or adhesives may be used.

Also, while the above described binder materials may be used to create an electrically lossy material by forming a binder around conducting particle fillers, the invention is not so limited. For example, conducting particles may be impregnated into a formed matrix material or may be coated onto a formed matrix material, such as by applying a conductive coating to a plastic component or a metal component. As used herein, the term "binder" encompasses a material that encapsulates the filler, is impregnated with the filler or otherwise serves as a substrate to hold the filler.

Preferably, the fillers will be present in a sufficient volume percentage to allow conducting paths to be created from particle to particle. For example, when metal fiber is used, the fiber may be present in about 3% to 40% by volume. The amount of filler may impact the conducting properties of the material.

Filled materials may be purchased commercially, such as materials sold under the trade name Celestran® by Celanese Corporation which can be filled with carbon fibers or stainless steel filaments. A lossy material, such as lossy conductive carbon filled adhesive preform, such as those sold by Techfilm of Billerica, Mass., US may also be used. This preform can include an epoxy binder filled with carbon fibers and/or other carbon particles. The binder surrounds carbon particles, which act as a reinforcement for the preform. Such a preform may be inserted in a connector lead frame subassembly to form all or part of the housing. In some embodiments, the preform may adhere through the adhesive in the preform, which may be cured in a heat treating process. In some embodiments, the adhesive may take the form of a separate conductive or non-conductive adhesive layer. In some embodiments, the adhesive in the preform alternatively or additionally may be used to secure one or more conductive elements, such as foil strips, to the lossy material.

Various forms of reinforcing fiber, in woven or non-woven form, coated or non-coated may be used. Non-woven carbon fiber is one suitable material. Other suitable materials, such as custom blends as sold by RTP Company, can be employed, as the present invention is not limited in this respect.

However, lossy members also may be formed in other ways. In some embodiments, a lossy member may be formed by interleaving layers of lossy and conductive material such as metal foil. These layers may be rigidly attached to one another, such as through the use of epoxy or other adhesive, or may be held together in any other suitable way. The layers may be of the desired shape before being secured to one another or may be stamped or otherwise shaped after they are held together.

In the embodiment illustrated in FIG. 4, the lossy material used to form body 410 may be a polymer filled with conductive particles such that body 410 may be shaped by molding and then curing the conductive polymer. Compliant conductive members 420 may be secured to shorting bar 5 by molding the polymer over one or more conductive members from which compliant conductive members 240 extend.

Contact between the lossy material of body 410 and the compliant conductive members contacting conductive elements within the receptacle 10 damps high frequency energy, such as may result from resonances in the conductive elements. A sufficient portion of the conductive members 420 may be positioned within body 410 to provide suitable mechanical integrity to shorting bar 5 and damping of high frequency energy. FIG. 4 illustrates an embodiment in which separate conductive members 430A and 430B extend from upper surface 412 and lower surface 414 respectively.

Figure 5:
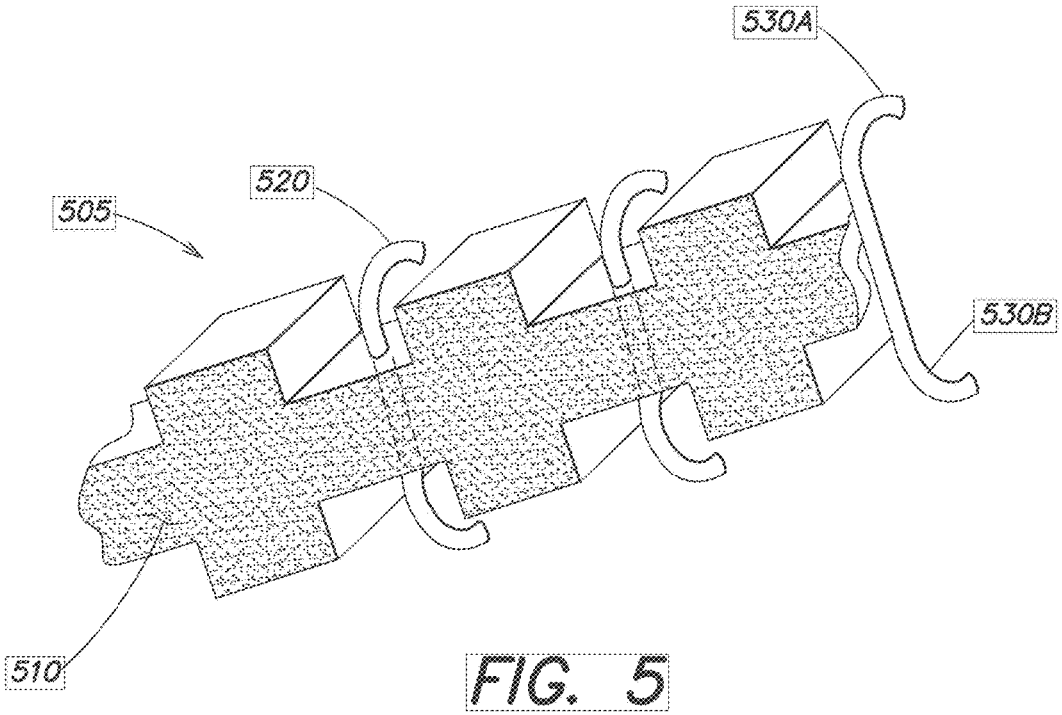
FIG. 5 is a perspective view, particularly cut away, of a second illustrative embodiment of a shorting member that may be installed in the receptacle connector of FIG. 1.

FIG. 5 illustrates an alternative embodiment of a shorting bar 505 compliant conductive members 520 may be positioned similarly to compliant conductive members 420. In this example, shorting bar 505 has a body 510 shaped similarly to body 410 (FIG. 4). Shorting bar 505 differs from the shorting bar five (FIG. 4) and similarly formed of lossy material in the shape of the conductive members 520 with in body 510. In this example, two compliant conductive members 520, extending from opposing surfaces of body 510, are opposing ends of a single conductive member. As shown in FIG. 5, that conductive member is C-shaped, with ends 530A and 530B extending from opposing surfaces of body 510. Having a conductive path between compliant conductive members may, in some embodiments, reduce resonances within the receptacle 10.

Figure 6:
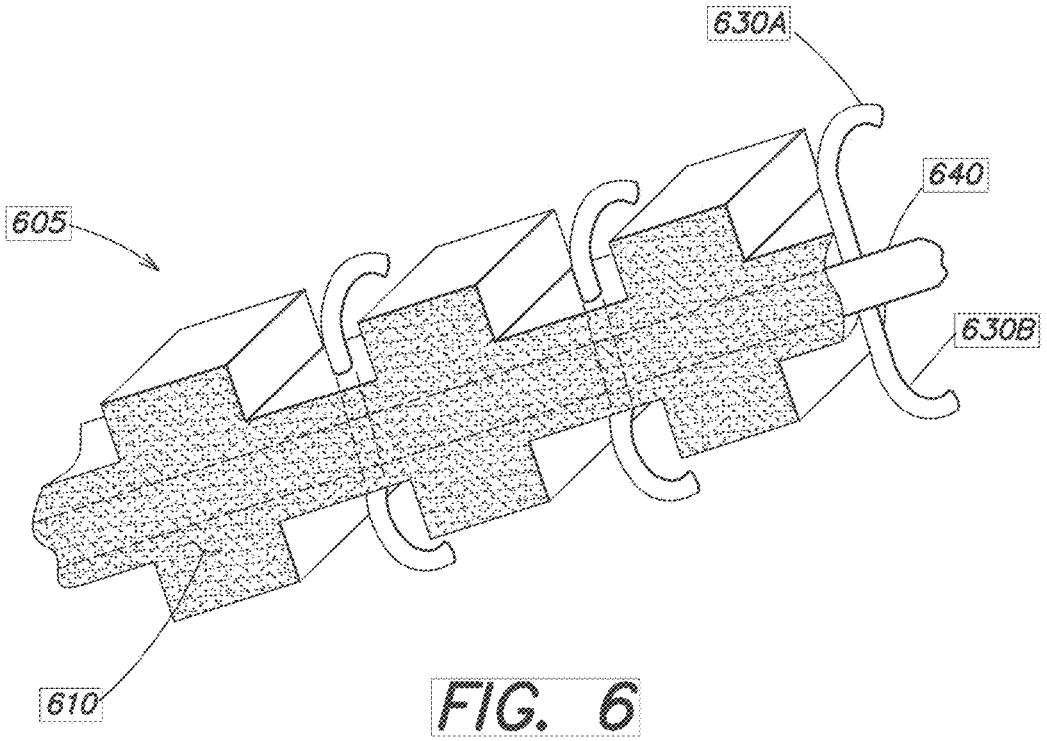
FIG. 6 is a perspective view, particularly cut away, of a third illustrative embodiment of a shorting member that may be installed in the receptacle connector of FIG. 1.

FIG. 6 shows a further alternative embodiment. Shorting bar 605 includes a body 610 also shaped similarly to body 410 and similarly formed of lossy material. The portions of complaint conductive members extending from body 610 may be shaped similarly to the extending portions shown in FIG. 4 and FIG. 5. In the example of FIG. 6, the compliant conductive members 630A and 630B's extending from opposing surfaces of body 610 are integrally formed from the same conductive member, as in FIG. 5. In addition, multiple compliant conductive members along the length of shorting bar 605 are connected together by a conductive web 640. The configuration illustrated in FIG. 6 may be formed, for example, by stamping a conductive insert from a sheet of metal. The conductive insert may include compliant conductive members extending over a portion or the full length of shorting bar 605, along with the conductive web 640 interconnecting those compliant conductive members. Body 610 may then be over molded on the insert. However, other construction techniques are possible.

In some embodiments, the connector may have assignments, reflecting an intended use of the conductive elements, and the compliant conductive members may be positioned to make contact with selective ones of the conductive elements based on their assignments. For example, pairs of adjacent conductive elements may be assigned as signal conductors intended for carrying a differential signal per pair. In some embodiments, the pairs may be separated by other conductive elements assigned as grounds. When mounted to a printed circuit board, the contact tails of these conductive elements may be attached to structures within the printed circuit board corresponding to the assigned use of the conductive elements: grounds may be attached to ground planes and signal conductors may be attached to signal traces, which may be routed in pairs, reflecting their use in carrying differential signals. The conductive members of the shorting bar may align with some or all of the conductive elements assigned as grounds.

FIG. 7 is a schematic diagram of specific definition of the conductive elements in a receptacle connector in accordance with an embodiment. Element 710 represents assignments of conductive elements in a first row, which may be on an upper surface of a port. Element 750 represents assignments of conductive elements in a second row, which may be on an opposing, lower surface of the port.

In the illustrated example, the conductive elements are assigned to provide one pair of clock signal pins, eight sideband pins and eight pairs of differential signal pins are respectively disposed on each of the upper and lower surfaces. The differential signal pins 720 respectively disposed on the upper surface and the lower surface are symmetrical with respect to each other. As can be seen, the differential signal conductors are disposed in pairs, and each pair is positioned between ground conductors. In accordance with some embodiments, conductive members of the shorting member may contact the ground conductors, as schematically indicated by the arrows contacting conductive elements at locations B1, B4, B7, B13, B16, B19, B22, B25, B31, B34, and B37. Also, conductive members make contact at locations A1, A4, A7, A13, A16, A19, A22, A25, A31, A34, and A37. When a shorting bar is present, the connector system may support higher frequency operation on signal pairs 420 then when the shorting bars is omitted.

Each group of symmetrical differential signal pins is respectively disposed on the upper surface and the lower surface in a staggered manner. For example, RX8 pins are arranged on the upper surface at B2 and B3 PIN location and TX8 pins which are symmetrical to RX8 are disposed on the lower surface at A35 and A36 PIN location. Other signal pins that are symmetrical with respect to each other are arranged in a staggered manner similarly, allowing the near end cross-talk to be effectively reduced. The arrangement of the defined pins is not limited to the above and any arrangements in which symmetrical differential signal pins are disposed on the upper surface and the lower surface in a staggered manner fall within the scope of the disclosure.

Having thus described several aspects of at least one embodiment of this invention, it is to be appreciated that various alterations, modifications, and improvements will readily occur to those skilled in the art.

For example, it was described that conductive members of the shorting bar are in electrical connection with conductive elements acting as grounds. It should be appreciated that "ground" does not necessarily imply earth ground. Any potential acting as a reference for high speed signals may be regarded as a ground. A "ground," therefore may have a positive or negative potential relative to earth ground or, in some embodiments, may be a low frequency signal, such as a control signal that changes level infrequently.

As an example of another variation, a shorting member was pictured for use in a connector with a pattern of signal pairs, separated by ground conductors. It should be appreciated that a uniform or repeating pattern is not required and that conductive members of a shorting member need not be regularly spaced. For example, a connector may have assignments in which some conductive elements are intended for use in carrying high frequency signals and some are intended only for low frequency signals. Fewer grounds may be present near signal conductors assigned for low frequency operation than near those assigned for high frequency signals, leading to a non-uniform spacing between the conductive members.

It was described that each conductive member in a shorting member makes electrical and mechanical contact with a corresponding conductive element in a connector. It is not a requirement that the elements be in mechanical contact. If the conductive members and conductive elements are closely spaced, adequate electrical connection may result to achieve a desired improvement in electrical performance of the connector. However, the inventors have recognized and appreciate that inclusion of compliant conductive elements extending from a lossy body improves the effectiveness of the shorting member at increasing high frequency performance of the connector, particularly for a dense connector.

Further, a shorting bar was illustrated in conjunction with a receptacle connector. It should be appreciated that a shorting bar, including a lossy body and extending complaint conductive members, may alternatively or additionally be used in a plug connector or a connector of any other format, including a right angle connector, or a mezzanine connection.

Figure 8:
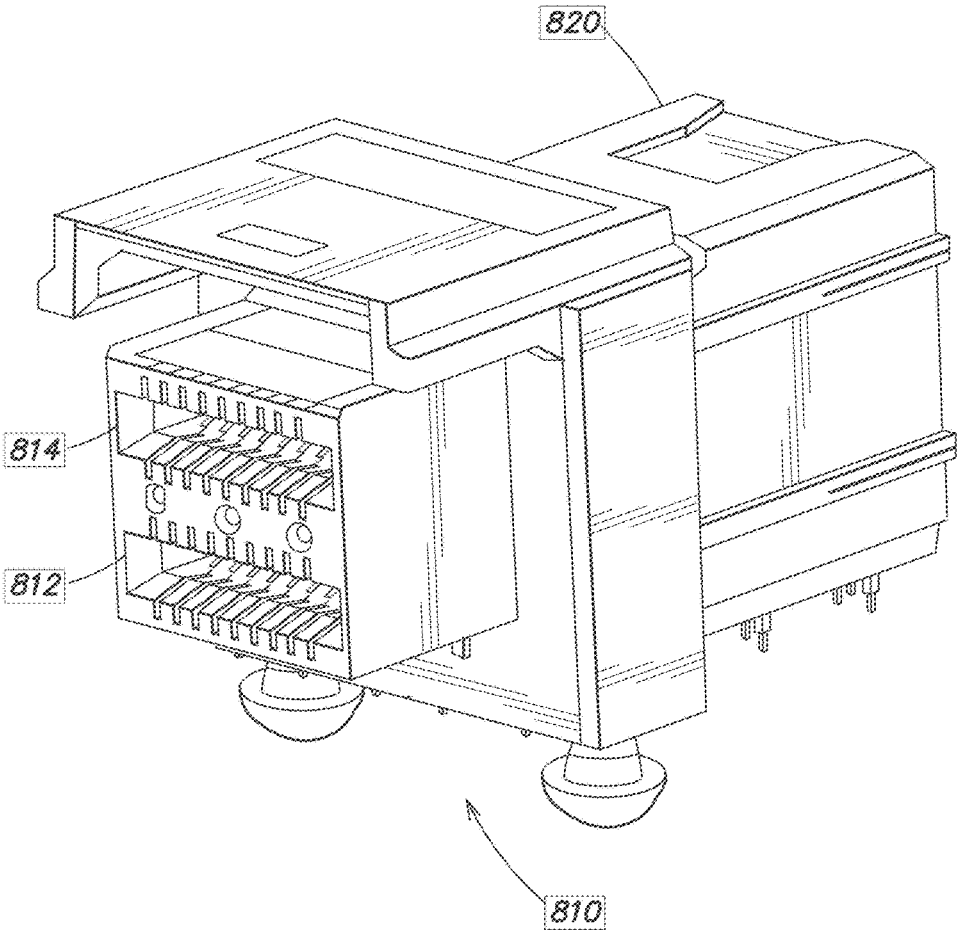
FIG. 8 is a perspective view of an embodiment of a receptacle connector with two ports, each of which may receive a shorting member as described herein.

As a further variation, it should be recognized that FIG. 1 illustrates a single port connector. Techniques as described above may be used to implement a multiport connector. FIG. 8, for example illustrates a dual port connector 810, with ports 812 and 814. A shorting bar may be associated with either or both of ports 812 and/or 814. For example, receptacle connector 810 may be formed within insulative housing 820 into which multiple contact wafers are inserted. In an embodiment in which each contact wafer includes a row of conductive elements, the two port connector illustrated in FIG. 8 may be constructed from four contact wafers, each providing a row of conductive elements for an upper or lower surface of a port 812 or 814.

As yet a further variation, a shorting bar is illustrated with conductive elements extending from two opposing surfaces so as to contact conductive elements in two parallel rows. It should be appreciated that a shorting bar may contact conductive elements in a single row or in more than two rows in some embodiments.

Moreover, it is described that a shorting bar is positioned between two parallel rows of conductive elements. It is not a requirement that the lossy member be configured as an elongated member. In some embodiments, the lossy member, positioned to electrically couple to the conductive elements in the rows may be annular, wrapping around the conductive elements. Such a lossy member may have projections adjacent ground conductors. Those projections may be compliant, such as may result from projections made of metal or a conductive elastomer. Alternatively the projections may be rigid, such as may result from molding the lossy member from a plastic material loaded with conductive fillers. Moreover, coupling between the lossy member and conductive elements intended to be connected to ground may alternatively or additionally be achieved by openings in the insulative housing between the lossy member and the ground conductive elements.

As an example of other possible configurations for the lossy member, two elongated members may be provided, one adjacent each row of conductive elements. As a further alternative, multiple lossy members may be coupled to the conductive elements of each row. As a specific example, two lossy members may each be positioned next to one half of the conductive elements in a row. However, it should be appreciated that any suitable number of lossy members each may be positioned adjacent any suitable number of conductive elements.

Other changes may be made to the illustrative structures shown and described herein. For example, techniques are described for improving signal quality at the mating interface of an electrical interconnection system. These techniques may be used alone or in any suitable combination. Furthermore, though the techniques described herein are particularly suitable for improving performance of a miniaturized connector, the size of a connector may be increased or decreased from what is shown. Also, it is possible that materials other than those expressly mentioned may be used to construct the connector.

Furthermore, although many inventive aspects are shown and described with reference to an I/O connector, and specifically a receptacle style connector, the techniques described herein may be applied in any suitable style of connector, including a daughterboard/backplane connectors having a right angle configuration, stacking connectors, mezzanine connectors, I/O connectors, chip sockets, etc.

In some embodiments, contact tails were illustrated as surface mount contacts. However, other configurations may also be used, such press fit "eye of the needle" compliant sections that are designed to fit within vias of printed circuit boards, spring contacts, solderable pins, etc., as aspects of the present disclosure are not limited to the use of any particular mechanism for attaching connectors to printed circuit boards.

Such alterations, modifications, and improvements are intended to be part of this disclosure, and are intended to be within the spirit and scope of the invention. Further, though advantages of the present invention are indicated, it should be appreciated that not every embodiment of the invention will include every described advantage. Some embodiments may not implement any features described as advantageous herein and in some instances. Accordingly, the foregoing description and drawings are by way of example only.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. An electrical connector comprising:

at least one subassembly comprising a plurality of conductive elements disposed in a first row, each conductive element of the plurality having a mating contact portion, a contact tail and an intermediate portion connecting the mating contact portion and the contact tail;

at least one member, the at least one member comprising lossy material and a plurality of conductive compliant members extending from the lossy material, wherein:

conductive compliant members of the plurality of conductive compliant members make electrical contact with a portion of conductive elements of the plurality of conductive elements of the at least one subassembly.

2. The electrical connector of claim 1, wherein:

the conductive compliant members are positioned to contact conductive elements of the first plurality of conductive elements that are separated by pairs of the conductive elements of the plurality of conductive elements.

3. The electrical connector of claim 1, further comprising a housing having a cavity with a first surface, and a second surface parallel to the first surface, wherein:

the mating contact portions of the plurality of conductive elements are exposed in the first or the second surfaces.

4. The electrical connector of claim 3, wherein:

the housing comprises a first plurality of channels in the first surface and a second plurality of channels in the second surface; and the mating contact portions of the at least one subassembly are disposed in at least one of the first plurality of channels and the second plurality of channels.

5. The electrical connector of claim 4, wherein:

the at least one member is disposed within the housing.

6. The electrical connector of claim 1, wherein:

the at least one subassembly comprises an insulative portion.

7. The electrical connector of claim 1, wherein:

the lossy material comprises a polymer and conductive fillers; and at least two of the conductive compliant members comprise extensions from a conductive member disposed within the lossy material.

8. The electrical connector of claim 1, wherein:

the at least one member further comprises:

a body with an upper side;

castellations disposed on the upper side of said body; and a metal member elongated in a direction parallel to the row; and a plurality of the conductive compliant members extending from the upper side of the body in locations between the castellations and integral with the metal member.

9. The electrical connector of claim 8, wherein:

the body comprises a polymer; and the metal member comprises a first portion embedded in the polymer, with the conductive compliant members extending from the first portion.

10. The electrical connector of claim 1, wherein the bulk conductivity of the conductive compliant members is at least ten times the conductivity of the lossy material.

11. An electrical connector, comprising:

a plurality of conductive elements, each conductive element of the plurality having a mating contact portion, a contact tail and an intermediate portion connecting the mating contact portion and the contact tail;

a housing holding the plurality of conductive elements in at least one row, wherein the housing comprises at least one opening through which intermediate portions of a portion of conductive elements of the plurality of conductive elements is exposed;

a member comprising:

an electrically lossy body elongated in a direction parallel to the row; and a plurality of conductive members extending from the lossy body, wherein:

the conductive members extend into the opening toward the intermediate portions of the portion of the plurality of conductive elements.

12. The electrical connector of claim 11, wherein:

the plurality of conductive members contact the intermediate portions of the portion of the plurality of conductive elements.

13. The electrical connector of claim 11, wherein:

the portion of the plurality of conductive elements consists essentially of conductive elements separated from an adjacent conductive element in the portion by a pair of conductive elements in the row.

14. The electrical connector of claim 11, wherein:

the member comprises a surface that is elongated in a direction parallel to the row; and each of the plurality of conductive members comprises a first portion extending through the surface, a bend, and a second portion separated from the first portion by the bend.

15. The electrical connector of claim 11, wherein:

the member comprises a metal member elongated in a direction parallel to the row; and the plurality of conductive members are integral with the metal member.

16. The electrical connector of claim 15, wherein:

the member comprises a polymer; and the metal member comprises a first portion embedded in the polymer, with the conductive members extending from the first portion.

17. The electrical connector of claim 11, further comprising:

an insulative housing, wherein the plurality of conductive elements are supported by the housing.

18. An electrical connector configured as a receptacle for a plug of a cable assembly, the electrical connector comprising:

an insulative housing comprising at least one cavity configured to receive the plug;

a plurality of conductive elements, each having a portion disposed within the at least one cavity; and a member disposed within the insulative housing, the member comprising lossy material and a plurality of conductive members extending from the lossy material, wherein:

conductive members of the plurality of conductive members align with and extend from the lossy material toward a portion of the conductive elements of the plurality of conductive elements, wherein the portion of the conductive elements are separated by pairs of the conductive elements of the plurality of conductive elements.

19. The electrical connector of claim 18 in an assembly comprising a printed circuit board, wherein:

the printed circuit board comprises at least one ground plane; and each conductive element of the portion of conductive elements is electrically coupled to the at least one ground plane.

20. The assembly of claim 19, wherein the printed circuit board comprises a plurality of pairs of signal traces; and the pairs of conductive elements of the first and second plurality of conductive elements are each coupled to a pair of the plurality of pairs of signal traces in the printed circuit board.

21. The assembly of claim 20, wherein the plurality of conductive elements comprise a subassembly, comprising a first insulative portion holding the plurality of conductive elements in a row;

the insulative portion comprises an opening therein; and the member is disposed at least partially within the opening.

* * * * *